United States Patent [19]

Dickinson

[11] 4,266,914

[45] May 12, 1981

[54] MAGNETIC DRIVE LABORATORY PUMP

[76] Inventor: David G. Dickinson, 1681 Larco Way, Glendale, Calif. 91202

[21] Appl. No.: 19,456

[22] Filed: Mar. 12, 1979

[51] Int. Cl.[3] ..... F04B 17/00; F04B 21/00

[52] U.S. Cl. ..... 417/63; 417/360; 417/420

[58] Field of Search ..... 417/420, 360, 63

[56] References Cited

U.S. PATENT DOCUMENTS

| | | | |
|---|---|---|---|
| 2,350,534 | 6/1944 | Rosinger | 417/420 |
| 2,373,609 | 4/1945 | Stahl | 417/420 |
| 2,941,477 | 6/1960 | Dalton | 417/420 |
| 3,411,450 | 11/1968 | Clifton | 417/360 X |

FOREIGN PATENT DOCUMENTS

| | | | |
|---|---|---|---|
| 1236325 | 6/1960 | France | 417/360 |

*Primary Examiner*—Richard E. Gluck
*Attorney, Agent, or Firm*—William H. Maxwell

[57] ABSTRACT

A laboratory pump for use with and in combination with a magnetic stirrer drive wherein a magnet field is revolved over a table upon which the pump is placed, said pump being comprised of manually press fitted elements establishing a viewable primer chamber accessible through a transparent cover for filling, and a submersible impeller chamber of circular form in which an impeller spins in equilibrium responsive to said revolving field, there being a central inlet into and a tangential outlet from the impeller chamber.

22 Claims, 9 Drawing Figures

MAGNETIC DRIVE LABORATORY PUMP

BACKGROUND

Laboratory processing of liquids requires the transport thereof through flow lines connecting vessels disposed at various levels. The liquids involved must be moved at determined flow rates, and they must not be contaminated. In practice, there are infinite arrangements of the apparatus involved and pumping is often required as an adaptation to transport a wide variety of liquids. For example, such liquids are electrophoresis buffers, sea water, cell suspensions, biological liquids, coolants, and any number of plating solutions, and the like. Accordingly, the pump herein disclosed is fabricated of materials unaffected by the liquid substance transported thereby, and such that it can be assembled without the complications of threads and/or solvent welds, the elements thereof being formed of plastic such as polyvinylchloride or a polytetrafluoroethylene polymer such as Teflon as manufactured by Dupont and which is substantially inert. These elements are simple and of open formation for cleanliness and for observation and priming of the pumping action, centrifugal action being employed through an impeller operating in a chamber isolated from the prime mover drive, utilizing a magnetic coupling. Reference is made to the prior art stirrers wherein a drive table provides a magnetic field that rotates and which is followed by magnetic stirring bars that are free to revolve within a closely positioned vessel in which liquid is to be agitated. It is a general object of this invention to employ such a stirrer table, as will be described, to drive a laboratory pump superimposed thereon and operable to be primed and operated with facility and under observation.

Pumps of the type under consideration are usually shaft driven and involve closed chambers and seals. Metallic bearings, shafts and impellers are usually employed, and access requires tedious disassembly. Furthermore, visibility of the pumping action is not available, and priming must be accomplished by improvision outside the pump. Accordingly, it is an object of this invention to eliminate closed inaccessible chambers, to eliminate all metallic parts, shafts and seals, and to provide in place thereof non-magnetic plastic parts adapted to visible inspection of the pumping function during operation and all of which are easily disassembled for installation modification and/or cleaning. A feature is the self priming of this pump with its integral priming chamber.

Drive tables of the type under consideration are common for use in stirring liquids within vessels superimposed thereon, and are referred to generally as "magnetic stirrers". It is an object of this invention to combine such a stirrer, without change thereto, with a liquid transporting pump especially adapted to laboratory use. The alignment of stirring bars within a vessel is not critical, but the alignment of a magnetic field rotating concentric with a pump drive axis is obviously a problem. However, criticality of this pump drive alignment is obviated by the present invention wherein the pump impeller seeks equilibrium within a wide range of misalignment with the axis of the drive table, precise alignment being impractical. With the present invention, the pump impeller is essentially a free spinning "top" stabilized gyroscopically in equilibrium with the magnetic drive axis even when axially offset, within practical limits. Further, the self alignment feature involves the inherent centering force of the magnetic attraction which tends to align the impeller and pump per se centered with the axis of the drive table.

SUMMARY OF INVENTION

This invention relates to a pump for the transport of liquids in the laboratory, isolated from contamination when moved from vessel to vessel in the execution of various processes. A magnetic drive table is employed in combination with this pump, coupled directly to an impeller through an imperforate wall by a magnetic field. The pump body comprises a submersible impeller chamber and a vessel or primer chamber that can be opened for filling and flooding the chamber in which the said impeller is free to revolve and seek equilibrium with respect to the axis of the drive table upon which the vessel and/or pump is loosely superimposed. In one form there is an inlet fitting opening into said primer chamber beneath which the said impeller chamber is submersed. In second and third forms the primer chamber is an open vessel in which the impeller chamber is submersed. The flow rate is determined by the speed at which the drive table is operated to rotate the pump impeller through the magnetic coupling.

DRAWINGS

The various objects and features of this invention will be fully understood from the following detailed description of the typical preferred forms and applications thereof, throughout which description reference is made to the accompanying drawings, in which.

Figure 1:
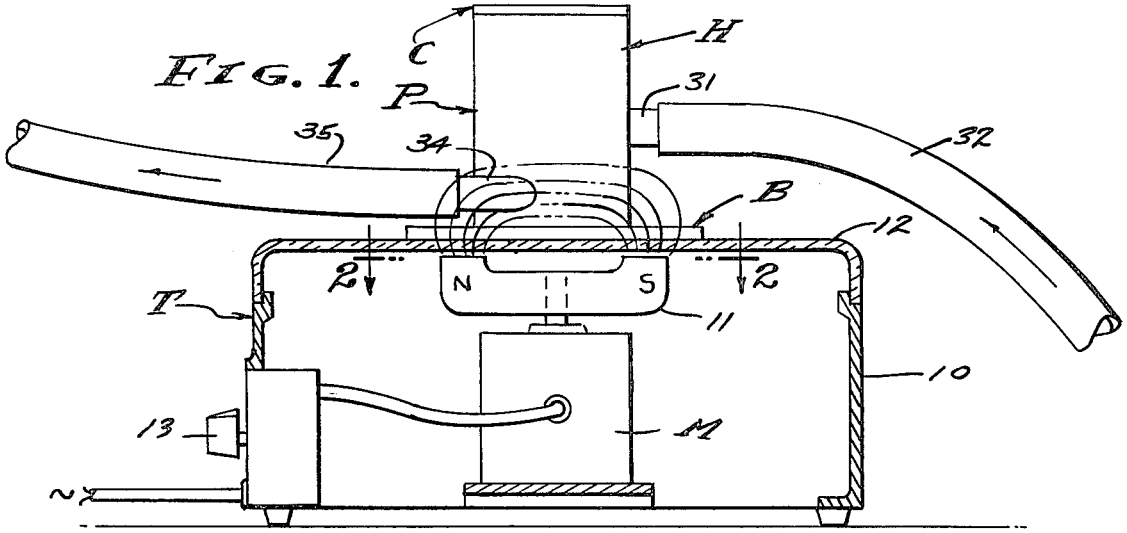
FIG. 1 is a vertical sectional view taken through a magnetic drive table, with the pump unit of the present invention superimposed thereon in operating position.
Figure 2:
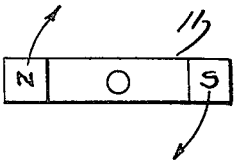
FIG. 2 is a plan section of the coupling magnet taken as indicated by line 2—2 on FIG. 1.
Figure 3:
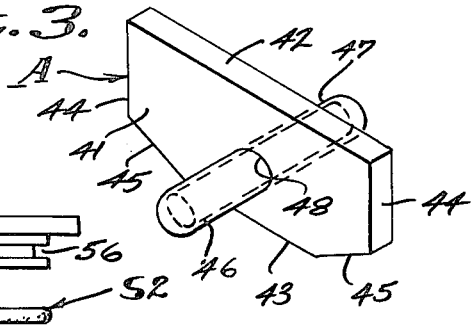
FIG. 3 is a perspective view of the pump impeller.
Figure 4:
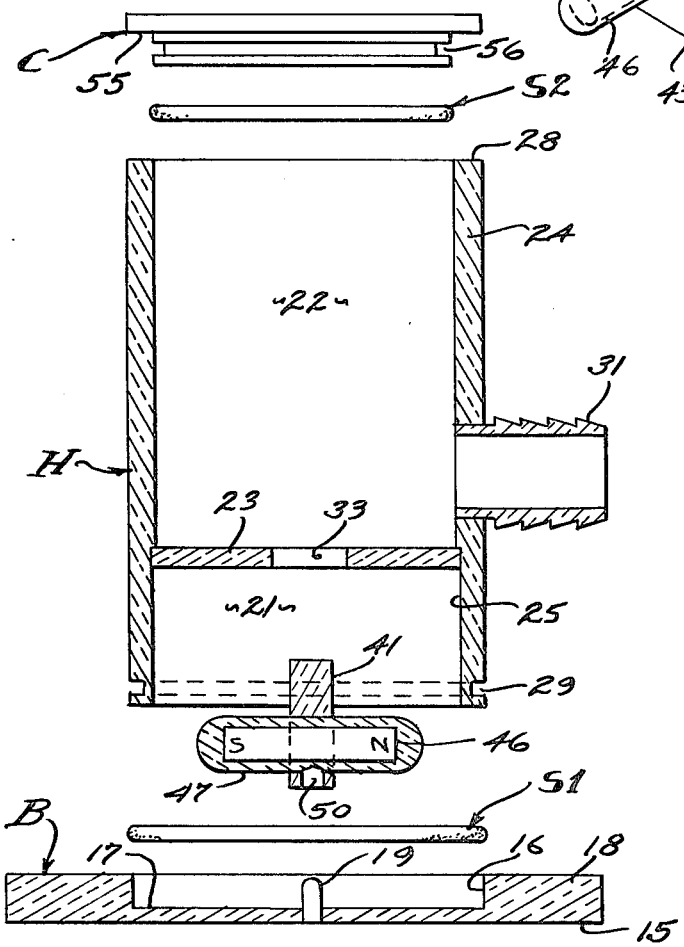
FIG. 4 is an exploded vertical sectional view comprised of the elements of the pump unit.
Figure 5:
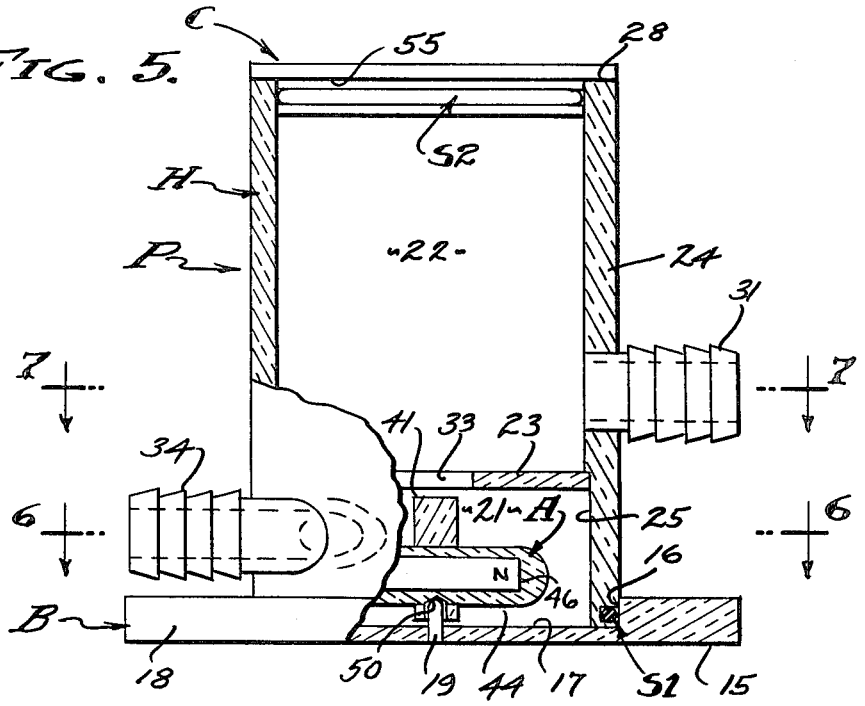
FIG. 5 is a view similar to FIG. 4 illustrating the pump unit assembly.
Figure 6:
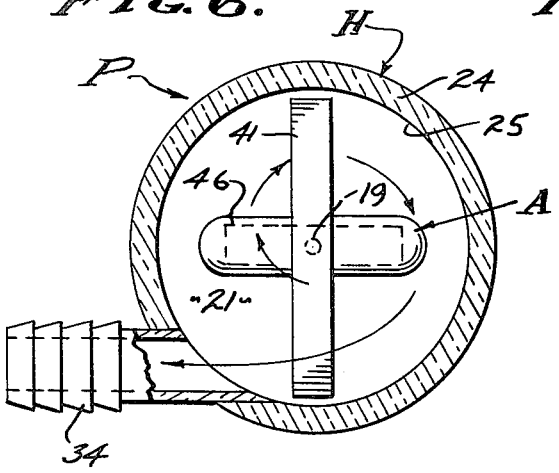
Figure 7:
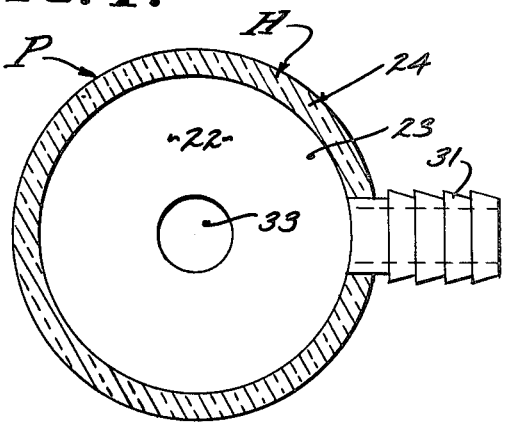
Figure 8:
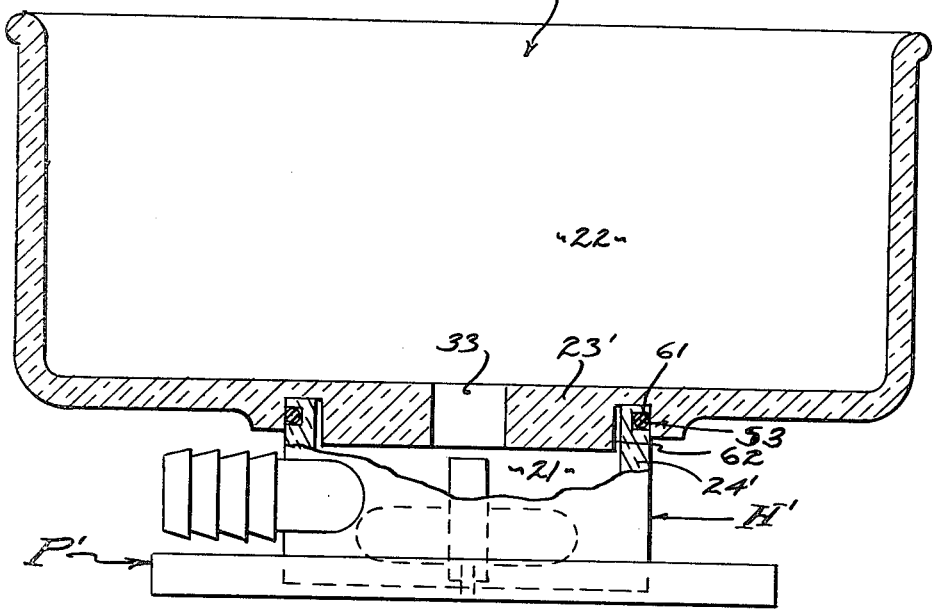
Figure 9:
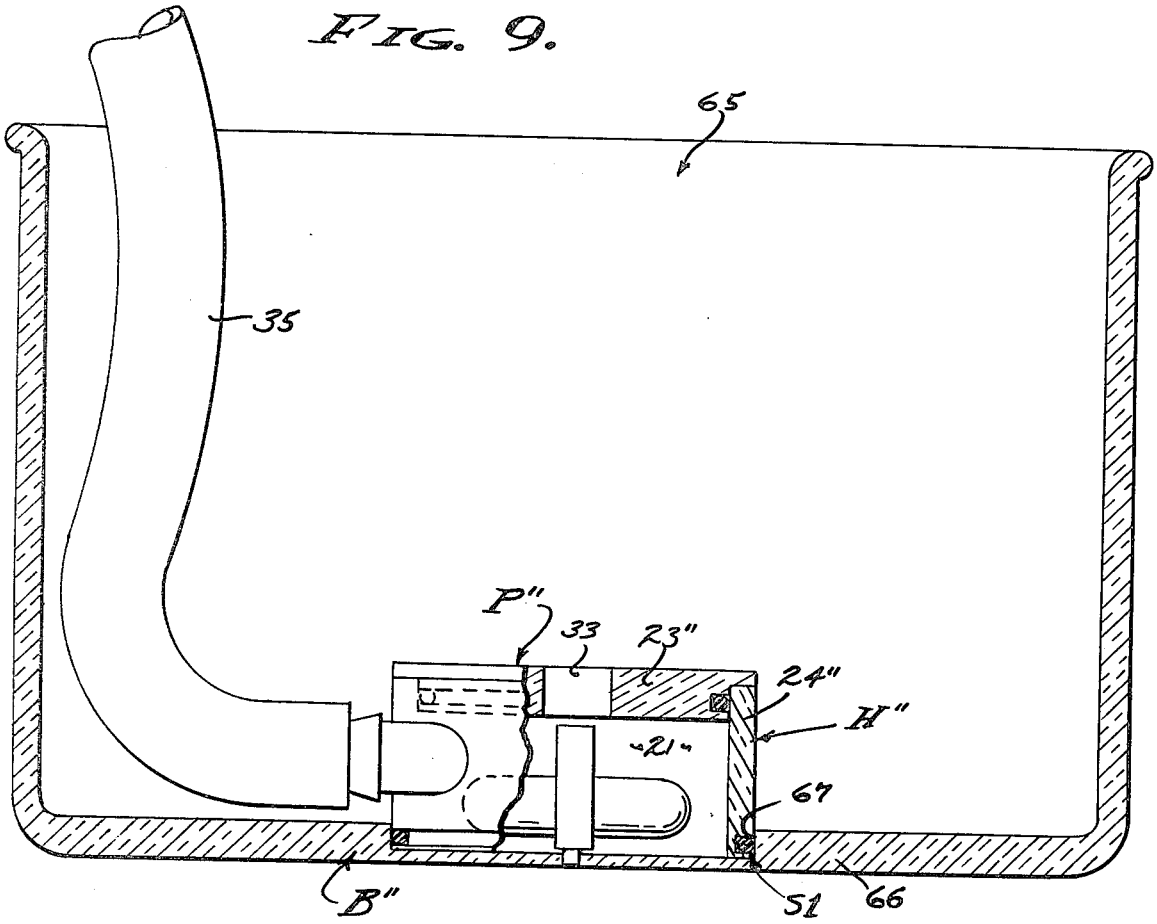

FIGS. 6 and 7 are transverse sectional views taken as indicated by lines 6—6 and 7—7 on FIG. 5, and FIGS. 8 and 9 are vertical sectional views of second and third forms of this pump and chamber combination wherein the impeller chamber is submersible in a vessel chamber.

PREFERRED EMBODIMENT

This invention involves a pump unit P for use with or in combination with a magnetic drive table T of the type used in laboratories for stirring liquids contained in vessels. A feature of this pump unit P is its dependency upon a drive table T or like application of a rotating magnetic field. These prior art drive tables are referred to as "magnetic stirrers" and which comprise generally a platform 10 in which a prime mover or motor M operates on a vertical axis to revolve a magnet 11 immediately beneath a horizontal planar top 12. The top 12 is nonmagnetic and the magnet 11 is of bar-configuration normal to and extending diametrically of the rotational axis. In practice, the north N and south S poles of the magnet are upwardly turned, so that the lines of magnetic flux pass upwardly through and over the top 12, transversely between the diametrically opposite poles equally spaced from the turning axis. Accordingly, as the magnet revolves when driven by the motor M, so revolves the magnetic field comprised of the lines of flux disposed over the top 12. The usual vessel and loose magnet bar for stirring are dispensed with and are not shown. Speed of field rotation is by a motor speed control means 13, by which angular momentum is gradually increased so that the magnetic coupling is not broken.

Referring now to the pump unit P the unit embodiment thereof in its assembled condition comprises generally a base B, a housing H, an impeller A, and a cover C. These elements are seperable nonmagnetic parts (except for the magnet element of the impeller) for individual handling, replacement and cleaning, and it is preferred that they be assembled by press fitting one with the other and with captured positioning of the impeller as it rests by gravity in working position. In carrying out this invention, the aforementioned elements are made of any plastic such as polyvinylchloride (PVC) except for the cover which is made of clear acrylic; or a choice of a substantially inert material can be made, such as that of Teflon and/or glass.

The base B is provided to support the pump as a unit upon the table top 12 and to carry the housing H with the impeller A in operating position. The base is a relatively thin planar element of nonmagnetic material having a flat bottom face 15 to rest upon the top 12 of the drive table, and free to move laterally in a plane normal to the axis of the rotating field. Although the housing H could be permanently secured to the base B, it is preferred that the housing H be press fitted into its installed position upon the base, and easily removed therefrom. Accordingly, the base B is bored concentric with the rotational axis to prevent a shoulder 16 for the slideable reception of the housing H, the bottom of the bore presenting a smooth flat top face 17 parallel with the bottom face 15. As shown, the surrounding margin 18 of the base projects a substantial distance for stability. And in accordance with this invention, the base includes a pivot 19 concentric with the shoulder 16, preferably an upstanding pivot upon which the impeller A is supported within the housing chamber 21 therefor. In practice, the pivot is a cylindrical pin that projects from the top face 17 a determined distance terminating in a rounded end for rotatable support of the impeller A.

The housing H is provided to establish an impeller chamber 21 and separate primer chamber 22, and is characterized by an intermediate wall 23 that separates the housing into said two chambers. The housing H comprises an open ended right cylinder of nonmagnetic material having a wall 24 with a counterbore 25 at its lower end portion 26 to permanently receive the wall 23 of disc form, the wall 23 being press fitted into the counterbore. The counterbore presents a step which positions the wall plane normal to the axis and spaced above the bottom open end 27 of the housing about one-half the inner diameter thereof, thereby establishing the impeller chamber 21. The position of the wall 23 is also spaced below the top open end 28 of the housing about one and one-half the inner diameter thereof, thereby establishing the fitting or primer chamber 22.

A feature is the facility of assembly and disassembly of the base B and housing H, the former being manually press fitted into the latter. Further, the releasable joinder of these two parts requires liquid tight sealing and to this end it is a seal S1 which serves this purpose and as a friction lock as well. In accordance with this invention, the cylinder wall 24 of the housing slides free within the shoulder 16, and it is the seal S1 which yields thereto and is frictionally engaged therewith. Accordingly, there is an annular groove 29 in the outer diameter of wall 24 to receive the seal S1 in the form of a circular O-ring of elastomeric material impervious to the liquids to be handled and which is deformed by radial pressures while frictionally engaging the shoulder 16, thereby securing the two elements against nondeliberate separation.

As shown in FIGS. 1 through 7, the primer chamber 22 has an inlet immediately above the wall 23, and comprised of a tubular barbed fitting 31 to receive a flexible hose or inlet tubing 32. Transfer of liquid from the primer chamber 22 is by means of a central opening 33 in wall 23, an opening of substantially the same diameter and capacity as that of the inlet fitting. And, discharge of liquid from the impeller chamber 21 is from a tangential outlet immediately below the wall 23, and comprised of a tubular barbed fitting 34 to receive a flexible hose or outlet tubing 35. It is significant that the impeller chamber 21 is circular, not volute, and that the discharge fitting 34 is tangentially disposed midway between wall 23 and top face 17 at any rotative position as may be required.

The impeller A is a spinner or "top" adapted to be supported upon the aforesaid pivot 19 to rotate thereon in response to following the rotating field provided by the drive table T. Although the impeller may take various forms it is made as simple as possible and comprised of a nonmagnetic blade 41 and a magnet bar 46 permanently assembled in a "cross" configuration. Static balance of this assembly is a requirement, and to this end the crossed members 41 and 46 are symmetrically disposed, the blade 41 extending diametrically in a vertical plane normal to the magnet bar 46 that extends diametrically on a horizontal axis intersecting the vertical axis of rotation. In practice, the blade 41 carries the magnet bar and is a rectangular solid having top and bottom edges 42 and 43 closely juxtaposed to the wall 23 and top face 17 respectively, and having opposite end edges 44 closely juxtaposed to the inner diameter of counterbore 25. The lowermost outer corners of the blade are truncated at 45, the planar area of the blade 41 substantially occupying the transverse cross section of the impeller chamber 21.

The magnet bar 46 is of right cylinder form encapsulated in a plastic sheath 47 molded concentrically thereover and permanently press fitted into an opening 48 through the blade 41 with its axis intersecting the rotational axis. In practice, the opening 48 is located near the bottom edge 43 of the blade so as to carry the magnet bar as close as practical to the top face 17 and top 12 of the base B. And, in accordance with this invention, the impeller includes a pivot 50 on the central rotational axis thereof, preferably a vertically disposed bearing socket to receive the aforesaid pivot pin 19, thereby locating the impeller A centrally within the chamber 21. In carrying out the invention, the bearing socket is bored to freely receive the pin 19 and with a conical bottom entered into the sheath 47, preferably of Teflon or the like, to have centered anti-friction bearing engagement.

The cover C is provided to close the primer chamber 22 and is a window element of transparent material through which liquid circulation can be observed. Also, through which priming is achieved! As shown, the cover C is a disc-shaped nonmagnetic element that overlies the top open end 28 of the housing H to close the chamber 22, and it is removable therefrom as circumstances require. A feature is the facility of applying and removing the cover C from the housing H, the former being manually press fitted into the latter. Further, the releasable joinder of these two parts requires fluid (gas or liquid) tight sealing and to this end there is a seal S2 which serves this purpose and as a friction securement as well. In practice, the periphery of the cover is stepped at 55 and undercut thereat by an annular groove 56 to receive the seal S2 in the form of a circular O-ring of elastomeric material impervious to the liquids to be handled and which is deformed by radial pressure while frictionally engaging the inner diameter bore of the housing, thereby securing the two elements against non-deliberate separation.

It is to be understood that the function of the primer chamber 22 is to submerse the impeller chamber 21, and therefore the upstanding cylinder wall 24 and wall 23 can take various forms in the pump installation at the bottom of the chamber from which liquids are to be pumped. Accordingly, the submersible concept is applicable through the bottom of any suitable vessel chamber which is nonmagnetic, the submersed impeller chamber feature remaining the same as described herein. As shown in FIG. 8 there is a pump unit P' wherein submersion of the impeller chamber 21 is by means of an enlarged chamber 22' established by a vessel 60 wherein the surrounding bottom 23' embodies the aforesaid wall 23 with the central opening 33 therein. The cylinder wall 24' surrounding the impeller chamber 21 remains unchanged with the exception of its upper perimeter which is provided with an annular groove 61 in the outer diameter of wall 24' to receive a circular O-ring seal S3. The bottom 23' of the vessel is channelbored at 62 for the slideable reception of the upper open end of the housing H to be frictionally secured and sealed by the depressible seal S3. As shown in FIG. 9 there is a pump unit P'' wherein submersion of the impeller chamber 21 is by means of an enlarged vessel 65 wherein the bottom is imperforate and the pump housing H superimposed thereon. In this third form, the bottom 66 of the vessel is the base B'' provided to support the pump housing, and accordingly said vessel base B'' is bored to present a shoulder 67 for the slideable reception of housing H'' forming the impeller chamber 21, the seal S1 hereinabove described being employed for its friction securement and seal capabilities. As shown in FIG. 9, the primer chamber is the vessel 65, in which case the housing H'' terminates at the top of the impeller chamber 21, the wall 23'' being secured permanently to the cylinder wall 24'', and the outlet tubing 35 extending from the interior of said open vessel.

From the foregoing it will be seen that I have provided a simple and sanitary combination of elements to be manually assembled as circumstances require so as to form a laboratory pump unit P (P' and P'') to be magnetically driven by the rotating field of a stirrer drive table T or the like. With the pump unit approximately centered upon the drive axis of the table T, the bar magnet 46 of impeller A will follow the rotation of said field and seek rotational equilibrium on its spinning axis. Liquid present in the primer chamber 22 (or vessel), established as by filling the standpipe configuration thereof will provide the necessary vacuum closure for efficient suction through inlet opening 33. Liquid passing centrally through opening 33 is acted upon centrifugally by the impeller blade 41 to be forced radially outward in a volute path so as to discharge through the tangential outlet fitting 34 and delivery into the outlet tubing 35. The rate of delivery is determined by the speed at which the drive table T is operated, the speed being applied gradually to avoid loss of the driving connection.

Having described only typical preferred forms and applications of my invention, I do not wish to be limited or restricted to the specific details herein set forth, but wish to reserve to myself any modifications or variations that may appear to those skilled in the art as set forth within the limits of the following claims:

I claim:

1. A liquid pump for use with a magnetic drive wherein a magnetic field is revolved on a vertical turning axis over a horizontally disposed table, and fabricated principally of non-magnetic members except as defined herein, and including; a planar base for superimposed support upon the drive table and having a pivot to be placed at the turning axis of said magnet field, a right cylinder housing upstanding from the base with its axis concentric with the pivot on the base and having a transverse wall separating the housing interior into an upper primer chamber and a lower impeller chamber and with a central opening in the wall for open communication between said chambers, a cover received by the housing to close the primer chamber, the impeller chamber being closed by the case, and a rotatable impeller supportably balanced upon the pivot and comprised of crossed blade and magnet bar members symmetrically disposed about the rotational axis of the pivot and substantially occupying the transverse cross sectional area of the impeller chamber, said magnet bar being encapsulated in a sheath and carried transversely through the blade with its north-south axis normal to and intersecting a vertical rotational axis of a pivot thereon complementary to and engageable with the first mentioned pivot on the base, there being a liquid inlet into the upper primer chamber and there being a liquid discharge opening from the impeller chamber and extending tangentially away from the direction of impeller rotation.

2. The magnetically driven pump as set forth in claim 1, wherein the cover is releasably secured to the housing by the frictional engagement of a depressible O-ring seal of elastomeric material, alternately for access and for ensuring a vacuum closure.

3. The magnetically driven pump as set forth in claim 1, wherein the right cylinder housing is releasably secured to the planar base by the frictional engagement of a depressible O-ring seal of elastomeric material, for removability and access to the impeller chamber in the housing.

4. The magnetically driven pump as set forth in claim 1, wherein the right cylinder housing is releasably secured to the planar base by the frictional engagement of a depressible O-ring seal of elastomeric material carried by a groove in the housing and frictionally engaged in a bore in the base.

5. The magnetically driven pump as set forth in claim 1, wherein the said pivots are of pin and socket configuration on the base and in the blade of the impeller respectively for balanced support and rotation within the impeller chamber upon the first mentioned pivot on the base.

6. The magnetically driven pump as set forth in claim 1, wherein the cover is secured to the housing by the frictional engagement of a depressible O-ring seal of elastomeric material and alternately for access and for ensuring a vacuum closure, wherein the right cylinder housing is releasably secured to the planar base by the frictional engagement of a depressible O-ring seal of elastomeric material carried by a groove in the housing and frictionally engaged in a bore in the base and wherein the said pivots are of pin and socket configuration on the base and in the blade of the impeller respectively for balanced support and rotation within the impeller chamber upon the first mentioned pivot on the base.

7. In combination: a magnetic drive having means generating a magnet field revolving on a vertical turning axis with lines of flux extending over a horizontally disposed table for planar support; and a liquid pump for driving placement substantially concentric with said turning axis of and upon the planar support of the table of said magnetic drive and fabricated of principally nonmagnetic members except as defined herein, and including; a planar base for superimposed support upon the drive table and having a pivot to be placed at the turning axis of said magnet field, a right cylinder housing upstanding from the base with its axis concentric with the pivot on the base and having a transverse wall separating the housing interior into an upper primer chamber and a lower impeller chamber and with a central opening in the wall for open communication between said chambers, a cover received by the housing to close the primer chamber, the impeller chamber being closed by the base, and a rotatable impeller supportably balanced upon the pivot and comprised of crossed blade and magnet bar members symmetrically disposed about the rotational axis of the pivot and substantially occupying the transverse cross sectional area of the impeller chamber, said magnet bar being encapsulated in a sheath and carried transversely through the blade with its north-south axis normal to and intersecting a vertical rotational axis of a pivot thereon complementary to and engageable with the first mentioned pivot on the base, there being a liquid inlet into the upper primer chamber and there being a liquid discharge opening from the impeller chamber and extending tangentially away from the direction of impeller rotation.

8. The magnetic drive and pump combination as set forth in claim 7, wherein the cover is releasably secured to the housing by the frictional engagement of a depressible O-ring seal of elastomeric material, alternately for access and for ensuring a vacuum closure.

9. The magnetic drive and pump combination as set forth in claim 7, wherein the right cylinder housing is releasably secured to the planar base by the frictional engagement of a depressible O-ring seal of elastomeric material, for removability and access to the impeller chamber in the housing.

10. The magnetic drive and pump combination as set forth in claim 7, wherein the right cylinder housing is releasably secured to the planar base by the frictional engagement of a depressible O-ring seal of elastomeric material carried by a groove in the housing and frictionally engaged in a bore in the base.

11. The magnetic drive and pump combination as set forth in claim 7, wherein the magnet bar of the rotatable impeller is encapsulated in a sheath carried by the blade thereof.

12. The magnetic drive and pump combination as set forth in claim 7, wherein, and wherein the said pivots are of pin and socket configuration on the base and in the blade of the impeller respectively for balanced support and rotation within the impeller chamber upon the first mentioned pivot on the base.

13. The magnetic drive and pump combination as set forth in claim 7, wherein the cover is secured to the housing by the frictional engagement of a depressible O-ring seal of elastomeric material and alternately for access and for ensuring a vacuum closure, wherein the right cylinder housing is releasably secured to the planar base by the frictional engagement of a depressible O-ring seal of elastomeric material carried by a groove in the housing and frictionally engaged in a bore in the base, and wherein the said pivots are of pin and socket configuration on the base and in the blade of the impeller respectively for balanced support and rotation within the impeller chamber upon the first mentioned pivot on the base.

14. A submersible liquid pump for use with a magnetic drive wherein a magnet field is revolved on a vertical axis over a horizontally disposed table, and fabricated principally of nonmagnetic members except as defined herein, and including; a planar base at the bottom of a vessel and for superimposed support upon the drive table and having a pivot to be placed at the turning axis of said magnet field, a right cylinder housing upstanding from the base with its axis concentric with the pivot on the base and having a transverse wall forming an impeller chamber and with a central opening in the wall for open communication into said vessel, the impeller chamber being closed by the base, and a rotatable impeller supportably balanced upon the pivot and comprised of crossed blade and magnet bar members symmetrically disposed about the rotational axis of the pivot and substantially occupying the transverse cross sectional area of the impeller chamber, said magnet bar being encapsulated in a sheath and carried transversely through the blade with its north-south axis normal to and intersecting a vertical rotational axis of a pivot thereon complementary to and engageable with the first mentioned pivot on the base, there being a liquid discharge opening from the impeller chamber and extending tangentially away from the direction of impeller rotation.

15. The magnetically driven submersible pump as set forth in claim 13, wherein the transverse wall is integral with and comprises at least a portion of the bottom of said vessel.

16. The magnetically driven submersible pump as set forth in claim 13, wherein the transverse wall is integral with and comprises at least a portion of the bottom of said vessel, and wherein the right cylinder housing is releasably secured to the transverse wall by the frictional engagement of a depressible O-ring seal of elastomeric material, for removability and access to the impeller chamber in the housing.

17. The magnetically driven submersible pump as set forth in claim 13, wherein the planar base is integral with and comprises at least a portion of the bottom of said vessel.

18. The magnetically driven submersible pump as set forth in claim 13, wherein the planar base is integral with and comprises at least a portion of the bottom of said vessel, and wherein the right cylinder housing is releasably secured to the planar base by the frictional engagement of a depressible O-ring seal of elastomeric material carried by a groove in the housing and frictionally engaged in a bore in the base.

19. The magnetically driven submersible pump as set forth in claim 13, wherein the right cylinder housing is releasably secured to the planar base by the frictional engagement of a depressible O-ring seal of elastomeric material, for removability and access to the impeller chamber in the housing.

20. The magnetically driven submersible pump as set forth in claim 13, wherein the right cylinder housing is releasably secured to the planar base by the frictional engagement of a depressible O-ring seal of elastomeric material carried by a groove in the housing and frictionally engaged in a bore in the base.

21. The magnetically driven submersible pump as set forth in claim 13, wherein the said pivots are of pin and socket configuration on the base and in the blade of the impeller respectively for balanced support and rotation within the impeller chamber upon the first mentioned pivot on the base.

22. The magnetically drive submersible pump as set forth in claim 13, wherein the right cylinder housing is releasably secured to the planar base by the frictional engagement of a depressible O-ring seal of elastomeric material carried by a groove in the housing and frictionally engaged in a bore in the base, and wherein the said pivots are of pin and socket configuration on the base and in the blade of the impeller respectively for balanced support and rotation within the impeller chamber upon the first mentioned pivot on the base.

* * * * *